United States Patent [19]

Bertelsen et al.

[11] 4,366,046

[45] Dec. 28, 1982

[54] SIZE SEPARATION OF OIL SHALE PARTICLES FOR EFFICIENT RETORTING

[75] Inventors: Corey A. Bertelsen, Oakland; Gene M. Handel, Lafayette, both of Calif.

[73] Assignee: Chevron Research Company, San Francisco, Calif.

[21] Appl. No.: 246,562

[22] Filed: Mar. 23, 1981

[51] Int. Cl.[3] ..... C10B 53/06; C10G 1/00

[52] U.S. Cl. ..... 208/11 R; 201/31

[58] Field of Search ..... 208/11 R

[56] References Cited

U.S. PATENT DOCUMENTS

| | | | |
|---|---|---|---|
| 3,167,494 | 1/1955 | Crawford | 208/11 R |
| 3,483,116 | 12/1969 | Hoffert | 208/11 |
| 3,499,834 | 3/1970 | Goins | 208/11 R |
| 3,976,558 | 8/1976 | Hall | 208/11 |
| 4,162,960 | 7/1979 | Dhondt | 208/11 |
| 4,199,432 | 4/1980 | Tamm et al. | 208/8 R |
| 4,243,510 | 1/1981 | Dhondt | 208/11 |

FOREIGN PATENT DOCUMENTS

| | | | |
|---|---|---|---|
| 715167 | 9/1954 | United Kingdom | 208/11 R |

*Primary Examiner*—Delbert E. Gantz
*Assistant Examiner*—Glenn Caldarola
*Attorney, Agent, or Firm*—D. A. Newell; S. R. LaPaglia; J. W. Ambrosius

[57] ABSTRACT

Oil shale particles separated into coarse- and fine-particle streams prior to retorting in a downward moving bed, wherein the fine particles enter the retort below the top of the fluidized bed to minimize entrainment before pyrolysis occurs.

5 Claims, 1 Drawing Figure

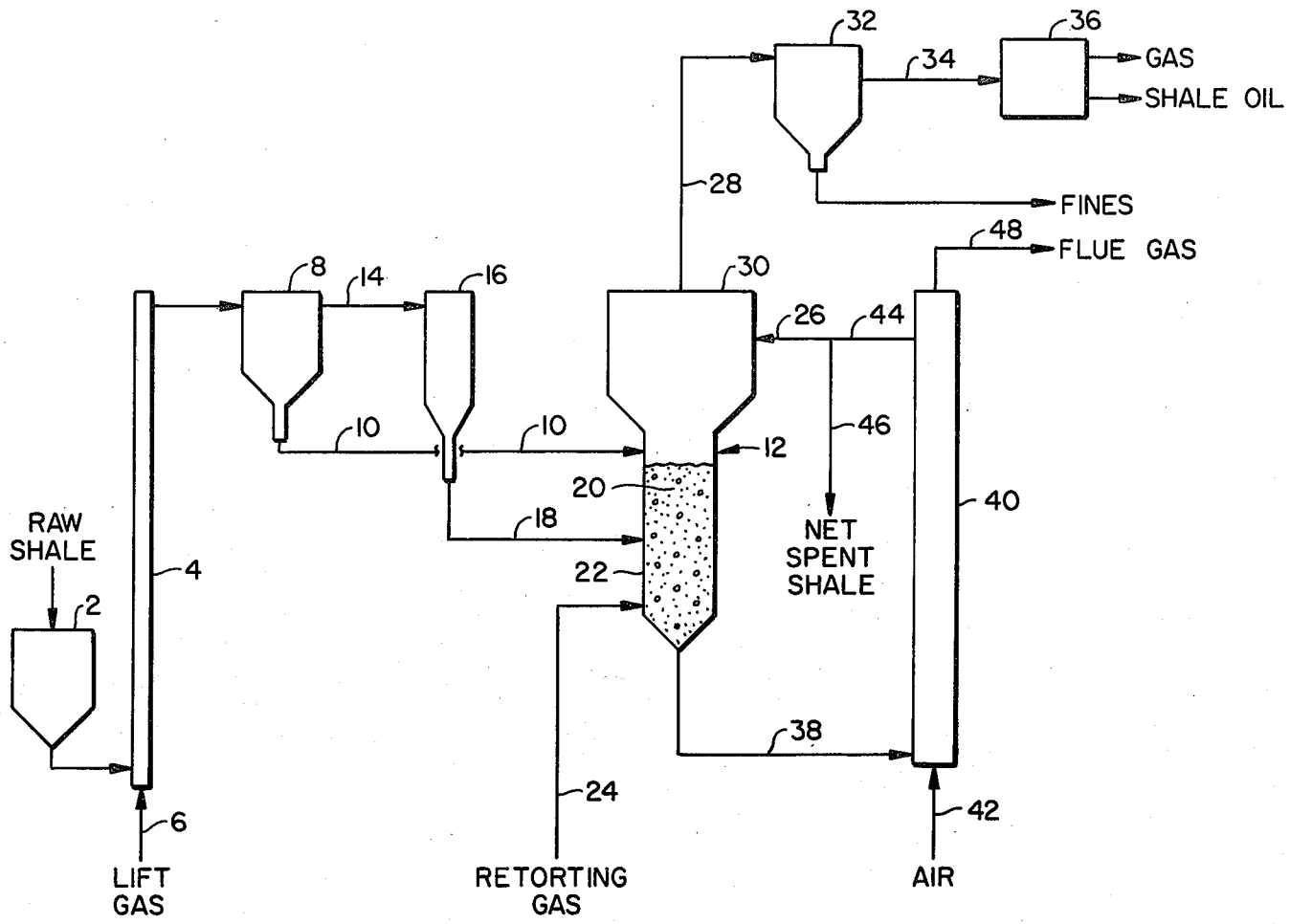
GAS
SHALE OIL
FINES
FLUE GAS
AIR
NET SPENT SHALE
RETORTING GAS
LIFT GAS
RAW SHALE
36
34
32
48
40
42
44
46
26
30
28
12
38
20
22
24
10
18
16
14
10
8
4
6
2

SIZE SEPARATION OF OIL SHALE PARTICLES FOR EFFICIENT RETORTING

BACKGROUND OF THE INVENTION

Oil shale is a naturally-occurring, shale-like rock which contains an organic component, usually referred to as kerogen, which upon heating releases volatile hydrocarbons which may be recovered as shale oil. A residual carbonaceous material typically remains with the inorganic component left following pyrolysis.

The pyrolysis or retorting process may be carried out in a retorting vessel of various designs. In one method, the raw oil shale is crushed and ground into particulate material which is fed into the top of the retorting vessel. The oil shale moves downward as a continuous bed of material through the retort. An upward flow of stripping gas countercurrent to the downward moving shale carries the volatile hydrocarbons away from the bed. See U.S. Pat. Nos. 4,199,432 and 3,167,494.

In such a retorting scheme, the countercurrent gas flow is usually sufficient to pneumatically entrain the finer particles of oil shale. Thus, the fine material entering the retort may become concentrated at the upper surface of the bed or be carried away with the stripping gas. The present invention is directed to a method for retorting oil shale without the disadvantages normally attendant to the presence of a fine shale fraction.

SUMMARY OF THE INVENTION

The invention involves a process for retorting oil shale which includes the steps of feeding particulate oil shale containing both fine- and coarse-grained material into the upper part of a retorting vessel, heating the oil shale as it moves downward as a continuous bed of material to pyrolyze the volatile hydrocarbons, introducing a stripping gas into the bottom of the retorting vessel causing an upward flow of gas countercurrent to the movement of the descending oil shale to carry away the volatile hydrocarbons, removing the retorted oil shale particles from the bottom of the retort, and recovering the volatile hydrocarbons from the stripping gas, wherein the improvement comprises separating prior to retorting a fine shale fraction containing particles smaller than a preselected particle size from the oil shale feed stream entering the retorting vessel and introducing said fine oil shale fraction as a separate feedstream into the retorting vessel at a position below the top of the bed of downward moving oil shale.

In a process of the type described above, the oil shale feed normally contains a mixture of particle sizes varying from a maximum size of about ½ inch to fines of less than 200 mesh (about 75 microns). Generally, the velocity of the countercurrent gas flow in the retorting vessel is in the range of from about 1 foot per second to about 5 feet per second with a preferred range of about 1 to about 2 feet per second. This is sufficient to entrain the finer particles of oil shale entering the retorting vessel. For the purposes of clarity in the following discussion, the term "fine particles" shall refer to particles of less than about 100 mesh, i.e., about 100 microns. Therefore, "coarse particles" shall refer to those particles equal to or larger than about 100 mesh. However, it should be understood that the terms "fine" and "coarse" are relative terms for which the size division may vary depending upon the precise details of the retorting process; the most important factor in determining the size cutoff is the velocity of the stripping gas passing through the retort. Thus, the operability of the invention is not limited by the terms "fine" and "coarse" to an exact size of particle.

BRIEF DESCRIPTION OF THE DRAWING

The FIGURE is a schematic representation of a process employing the invention.

DETAILED DESCRIPTION OF THE INVENTION

Referring to the drawing, raw oil shale previously crushed and ground to a maximum particle size of about ½ inch, preferably no larger than about ¼ inch, is fed into a hopper 2. The hopper empties into the bottom of pneumatic lift pipe 4 where the particles of raw shale are entrained and carried upward by a lift gas entering through lift gas conduit 6. Shale particles leaving the top of the lift pipe are carried to a rough cut cyclone 8 where particles larger than a preselected size are disengaged and sent via coarse solids conduit 10 to the retorting vessel 12. The entrained fine particles in the rough cut cyclone 8 are carried by conduit 14 to the fines cyclone 16. The fine raw oil shale particles pass by way of fine solids conduit 18 to the retorting vessel 12 entering at a level below the top of the bed of oil shale material 20 contained in the lower part 22 of the retorting vessel. The bed of oil shale 20 is partially fluidized by a retorting gas, preferably steam or other non-oxidizing gas entering the bottom of the retort via retorting gas conduit 24. Hot burned shale, i.e., oil shale from which the residual carbonaceous material has been burned off following retorting, entering the retorting vessel via conduit 26 serves as heat transfer material to raise the temperature of the raw shale to a level at which pyrolysis occurs. The retorting gas, volatile hydrocarbons released from the kerogen by pyrolysis, and fine shale particles are carried upward in the retorting vessel and exit via conduit 28. The upper part 30 of the retorting vessel is of larger diameter than the lower part 22 and serves as a solids disengaging area. Fine material is separated from the gaseous material leaving the retorting vessel in cyclone 32. The gaseous material from cyclone 32 is sent via conduit 34 to a product separation area 36 where the shale oil is separated from the other gases.

Referring back to the retorting vessel, aside from the fines, the retorted oil shale, i.e., shale having undergone pyrolysis and containing residual carbonaceous material, mixed with heat transfer material (recycled burned shale) leaves the bottom of the retorting vessel via conduit 38 and enters the bottom of the combustor 40. The shale particles are entrained by a stream of air entering the combustor via air conduit 42 and carried upward. The carbonaceous residue in the retorted oil is burned to heat up the shale particles. The burned shale leaves the combustor by conduit 44. Burned shale serving as heat transfer material is recycled via conduit 26, and excess burned shale is withdrawn via conduit 46. Flue gas leaves the combustor by means of flue gas conduit 48.

The use of the lift pipe 4 in combination with cyclones 8 and 16 is a relatively simple and efficient means for separating the fine material from the coarse material prior to retorting. In processes employing a preheater to warm the shale before entering the retorting area, the lift pipe may serve the dual functions of a preheater and a means for raising the raw shale to the cyclones and retorting vessel. In carrying out the invention, means other than cyclones can be employed to separate the fine shale particles from the coarse material. For example, screens can be used having a mesh size sufficient to allow the fine particles to pass through but too small to allow passage of the coarse material. Such sifting means are well known to those skilled in the art and should require no further explanation.

The process of the invention is particularly advantageous when used in conjunction with a retorting vessel of the type described in U.S. Pat. No. 4,199,432. Such retorting vessels are characterized as a vertically oriented vessel containing internal dispersing elements so constructed and arranged to prevent gross backmixing and slugging of solids passing downward therethrough. Retorting vessels of this general design are generally described as a staged turbulent bed retort. The dispersing elements may take the form of baffles, screens, perforated plates, bars, or the like. The dispersing elements are arranged to encourage true plug flow of the moving bed of material.

In retorting methods as described above, the countercurrent flow of gas in the retort generally has a velocity in the range of from about 1 foot per second to about 5 feet per second, with a preferred range of from about 1 to about 2 feet per second. These velocities are usually sufficient to entrain particles equal to or smaller than about 100 mesh; therefore, this would represent the preferred size at which the cut occurs. However, if the velocity of the retorting gas is higher or lower than this range, another cut size may be preferred.

In processes employing a lift pipe, the velocity of the lift gas will depend on the size and density of the raw shale particles. The velocity of the lift gas must be sufficient to prevent choking or collapse of the solids in the pneumatic lift pipe. For a raw shale feed containing a maximum particle size of $\frac{1}{4}$ inch, a lift gas velocity of at least 80 feet per second, more preferably at least 100 feet per second, is required to prevent choking.

What is claimed is:

1. In a process for retorting oil shale which includes the steps of feeding particulate oil shale containing both fine- and coarse-grained material into the upper part of a retorting vessel, heating the oil shale as it moves downward by mixing therewith a particulate hot heat transfer material to pyrolyze the volatile hydrocarbons, introducing a non-oxidizing stripping gas into the bottom of the retorting vessel at a velocity sufficient to partially fluidize the particles in the retort and entrain the fine-grained particles of oil shale causing an upward flow of gas countercurrent to the movement of the descending oil shale to carry away the volatile hydrocarbons, removing the retorted oil shale particles from the bottom of the retort, and recovering the volatile hydrocarbons from the stripping gas, wherein the improvement comprises separating prior to retorting a fine shale fraction containing particles smaller than a preselected particle size from the oil shale feed stream entering the retorting vessel and introducing said fine oil shale fraction as a separate feedstream into the retorting vessel at a position below the top of the bed of downward moving shale.

2. The process of claim 1 wherein the retorting vessel is vertically oriented and contains internal dispersing elements so constructed and arranged to encourage true plug flow of the bed of material passing therethrough.

3. The process of claim 2 wherein the separation between the coarse and fine particles takes place in a cyclone.

4. The process of claim 2 or 3 wherein a pneumatic lift pipe is used to entrain the coarse and fine shale particles prior to separation.

5. The process of claim 2 wherein the fine particles are smaller than about 100 microns.

* * * * *